US006957482B2

(12) United States Patent
Shimai et al.

(10) Patent No.: US 6,957,482 B2
(45) Date of Patent: Oct. 25, 2005

(54) SPACE FORMING APPARATUS FOR A SLIDE FASTENER CHAIN

(75) Inventors: Hideo Shimai, Toyama-ken (JP); Akira Sakai, Toyama-ken (JP)

(73) Assignee: YKK Corporation, Tokyo (JP)

( * ) Notice: Subject to any disclaimer, the term of this patent is extended or adjusted under 35 U.S.C. 154(b) by 265 days.

(21) Appl. No.: 10/235,782

(22) Filed: Sep. 6, 2002

(65) Prior Publication Data

US 2003/0074775 A1 Apr. 24, 2003

(30) Foreign Application Priority Data

Oct. 1, 2001 (JP) ..... 2001-305215

(51) Int. Cl.[7] ..... A41H 37/06; B23P 19/02

(52) U.S. Cl. ..... 29/770; 29/766; 29/408; 29/410; 29/426.4

(58) Field of Search ..... 29/770, 766, 33.2, 29/408, 410, 426.4, 426.3, 426.5

(56) References Cited

U.S. PATENT DOCUMENTS 4,131,223 A * 12/1978 Aureli ..... 225/94
4,573,383 A * 3/1986 Matsumoto ..... 83/111
4,738,016 A * 4/1988 Samberg ..... 29/408
5,103,540 A * 4/1992 Hirasawa ..... 29/33.2
5,212,863 A * 5/1993 Matsumoto ..... 29/408

* cited by examiner

*Primary Examiner*—Marc Jimenez
(74) *Attorney, Agent, or Firm*—Finnegan, Henderson, Farabow, Garrett & Dunner, L.L.P.

(57) ABSTRACT

The space forming apparatus includes at least a pair of fixed grippers disposed in a lower part thereof; a pair of movable grippers disposed with a gap in a front-to-rear direction such that the movable grippers are movable in a vertical direction toward and away from the aforementioned fixed grippers; a knock-out which is provided between the fixed grippers and moves vertically between said fixed grippers and between the movable grippers; and a punch section which is disposed so as to oppose a top end of the knock-out and which moves vertically and independently between the front and rear movable grippers and cuts coupling heads of coupling elements while pressing the coupling heads downward at the time of cutting. These members are accommodated integrally in a single housing having a chain insertion opening provided in a front face thereof.

6 Claims, 5 Drawing Sheets

SPACE FORMING APPARATUS FOR A SLIDE FASTENER CHAIN

BACKGROUND OF INVENTION

1. Art Field of Invention

The present invention relates to a space forming apparatus for a slide fastener chain to which continuous synthetic-resin-made elements are attached along a side edge of a fastener tape thereof by sewing. More specifically it relates to a space forming apparatus for removing groups of said elements each having a predetermined length with a predetermined interval in a longitudinal direction of the long slide fastener chain.

2. Prior Art

Conventionally, a continuous space forming apparatus for a slide fastener chain, in which spaces are successively formed in the slide fastener chain being carried intermittently, has been disclosed in for example, Japanese Utility Model Application Laid-Open No. 60-176606 or Japanese Patent Application Publication No. 6-42847 and has been already reduced into practice. In this kind of the space forming apparatus as well as the space forming apparatus disclosed in these publications, all the mechanical components and operating members which compose the apparatus are necessarily assembled and installed to a frame.

According to the above-described Japanese Utility Model Application Laid-Open No. 60-176606, there are a pair of guide plates, which serve as grippers for forming a guide gap for the slide fastener chain on a frame, at the front and rear sides. A front-side guide plate is disposed so as to be capable of moving obliquely between the above of the front side and its normal guide position. When the slide fastener chain is being inserted, the front-side guide plate is moved upward to the front side so as to widen the chain insertion opening, so that the insertion can be facilitated. When the insertion of the slide fastener chain is terminated, the aforementioned guide plate is moved to the normal guide position.

According to the above-described Japanese Patent Application Publication No. 6-42847, on the other hand, the grippers, which are equivalent to the aforementioned pair of the guide plates, are fixed on a frame such that they oppose each other. When the slide fastener chain is being inserted, the gripper on the front side is removed from the frame.

To assemble each composition unit or an operating member, a number of components are required, for which a high processing accuracy is demanded. Further, at the time of such assembly or installation, a number of composition units and members including guide members and frames need to be assembled one by one. Therefore, it takes a long time to position for the assembly and adjust the timing between respective operating members. Particularly, in the space forming apparatus disclosed in the Japanese Utility Model Application Laid-Open No. 60-176606, the number of the operating members for moving the guide plates and installation parts thereof are increased thereby complicating the installation work.

Further, if it is intended to insert a new slide fastener chain, according to the aforementioned Japanese Utility Model Application Laid-Open No. 60-176606, the guide plate needs to be moved from the normal position to an insertion position on the front side. In the space forming apparatus disclosed in the above-mentioned Japanese Patent Application Publication No. 6-42847, the fixed gripper needs to be removed from the frame, and then after the insertion of the slide fastener chain is completed, the gripper needs to be installed on the frame again. In either case, there is such a problem that the slide fastener chain cannot be inserted easily.

Usually, this kind of space forming apparatus has, on a lower base thereof, lower members such as a pair of front and rear fixed grippers which serve as guide plates, a pair of front and rear movable cutters which move vertically between the pair of fixed grippers, a knock-out which moves vertically between the movable cutters independently. Further, above of these members, the space forming apparatus has upper members such as a pair of front and rear movable grippers which are disposed at a predetermined interval and moves vertically or are fixed while cooperating with the fixed grippers or a punch which descends and presses the coupling head side of a coupling element row downward.

Most of the upper members move vertically at a predetermined stroke as being guided by the guide member. Thus, although a predetermined gap is set between the upper members and the lower members, at least a gap relative to the upper limit position of the aforementioned punch is needed. This gap is a relatively large gap as can be understood from the diagrams of the above-described publications. Thus, the fingers are likely to be inserted into this gap. Further, if any safety device is installed, the mechanism would be further complicated.

After spaces are formed by cutting out the coupling elements, the cut wastes are discharged to the front side of the forming apparatus. At this time, in general, they are blown out and discharged to the front side of the apparatus from the rear side by such means as compressed air. For that reason, the cut wastes are likely to be accumulated in the surrounding of the apparatus thereby leading to worsening of the working environment.

SUMMARY OF THE INVENTION

The present invention has been achieved to solve all these problems. According to the point of the invention, the object is to provide a space forming apparatus for a slide fastener chain in which the apparatus thereof is made compact and the installation of various kinds of composition units and operating members is facilitated, and which ensures easiness and safety at the time of insertion of the slide fastener chain and is capable of discharging cut wastes of coupling elements effectively and collecting them without scattering around the apparatus.

According to the present invention, therefore, the object can be achieved by a space forming apparatus comprising chain supplying means for intermittently supplying a long slide fastener chain, which is attached with right and left coupling elements continuously along opposing side edges of a pair of fastener tapes thereof, the space forming apparatus being disposed at a conveying path for a slide fastener chain to remove the coupling elements of a predetermined length successively from said slide fastener chain, wherein said space forming apparatus comprises: a pair of fixed grippers forming at least part of the conveying path; a pair of movable grippers which are cooperatively movable in a vertical direction toward and away from said slide fastener chain conveying path; a knock-out, which is provided between said pair of fixed grippers and moves vertically between said fixed grippers and between said movable grippers; and a punch section, which is disposed so as to oppose a top end of the knock-out and which moves vertically and independently between said pair of movable grippers and cuts coupling heads of the coupling elements while pressing the coupling heads at the time of being cut, and said fixed grippers, said movable grippers, said knock-out and said punch section are accommodated integrally within a single housing having a conveying path for the slide fastener chain.

Further preferably, a chain insertion opening, which communicates with the conveying path for said slide fastener chain, is provided at a front of the housing.

Because all the composition units and the operating members are incorporated in a single housing which are preliminarily assembled in an enclosed state, centering of these components is facilitated and the components can be assembled easily. Furthermore, an operating positions between the respective operating members can be adjusted easily. Further, because the number of guide members for guiding the operating members and supporting members decreases, so that the number of required parts can be reduced, which is advantageous in terms of price.

Further, it is preferable that an opening gap of the chain insertion opening and the conveying path for said slide fastener chain is set to be slightly larger than thickness of the slide fastener chain at a coupling element attaching portion thereof. This opening gap is formed in the housing preliminarily and can be set arbitrarily with respect to the internal devices which operate vertically. Thus, this can be of any size as far as it is large enough for the slide fastener chain to be inserted. According to the present invention, a minimum gap can be secured for inserting the slide fastener chain, thereby avoiding a risk that the finger may be inserted.

Therefore, according to the present invention, any special safety device does not have to be installed. The slide fastener chain can be inserted or removed without operating any other operating members or without removal/installation work of such interference members as grippers, which may interfere with the insertion of the slide fastener chain. The insertion and removal of the slide fastener chain can be carried out only through the opening gap which is an insertion opening for the fastener member. Therefore, the insertion and removal of the slide fastener chain can be executed easily with the safety.

Further preferably, a top portion of said chain insertion opening of the housing, a rear side wall portion of the housing and said pair of movable grippers have through holes, which communicate with each other, the through hole formed at the top portion of said chain insertion opening of the housing being connected to an outside compressed air source via through a pipe.

Because in the space forming apparatus of the present invention, the main units and the operating members are accommodated and installed in a single housing as described above, the interior of the housing is almost filled with the respective members. Especially, by using this filled state of the housing, an air passage is formed in part thereof and has an inlet thereof connected to a compressed air source while its outlet is opened to outside.

More specifically, as an air-passage-forming portion, the front and rear side wall portions of the housing and the pair of front and rear movable grippers are employed. Because the housing is fixed, it is preferable to form an air passage and provide an outlet and an inlet for the compressed air. On the other hand, after the punch section descends and cuts the coupling elements, the movable grippers remains at a gripping position as the lowest descent position while the punch section ascends to discharge cut wastes of the coupling elements. When the movable grippers grip the slide fastener chain, the aforementioned opening gap of the housing is closed, so that the interior of the housing is sealed to the utmost. Therefore, it is reasonable to form the air passage in the movable grippers by communicating the air passage with the one in the housing.

Furthermore, it is preferable that the through holes of said pair of movable grippers are formed so as to communicate with at least said other through holes a lower limit position of said movable grippers. As described above, when the movable grippers are located at the lowest descent position while gripping the slide fastener chain, coupling elements are cut and removed. Therefore, at this time, the through holes formed in the movable grippers at least need to communicate with the through holes formed in the housing.

DESCRIPTION OF PREFERRED EMBODIMENTS OF THE INVENTION

The present invention is especially preferable for a space forming apparatus which cuts out and removes fastener elements of a predetermined length at predetermined intervals, in a slide fastener chain having fastener tapes attached with synthetic-resin-made coil-like fastener elements by sewing.

Further, this space forming apparatus is capable of removing the fastener elements from the slide fastener chain on which synthetic-resin-made coil-like fastener elements are attached at the same time when the fastener tapes are knitted or woven.

Hereinafter, the preferred embodiments of the present invention will be described in detail with reference to the accompanying drawings.

FIGS. 1 to 4 schematically show an appearance of a space forming apparatus for a slide fastener chain and its major components according to a typical embodiment of the present invention. The example shown here is only an optimal embodiment but may be modified in various ways by those skilled in the art. Because the operating mechanism and the operation procedure of these operating members are substantially the same as the conventional ones, description of specific mechanism of those is omitted here.

In the apparatus 100 of this embodiment, a long slide fastener chain C, on which coil-like continuous right and left coupling elements E are attached with sewing threads along opposing side edges of a pair of right and left fastener tapes T thereof, is intermittently transferred by every predetermined length by means of a chain supply unit 10. Here, the chain supply unit 10 does not have to be provided with any special structure according to the invention but may be any carrying means with a generally known mechanism.

Figure 1:
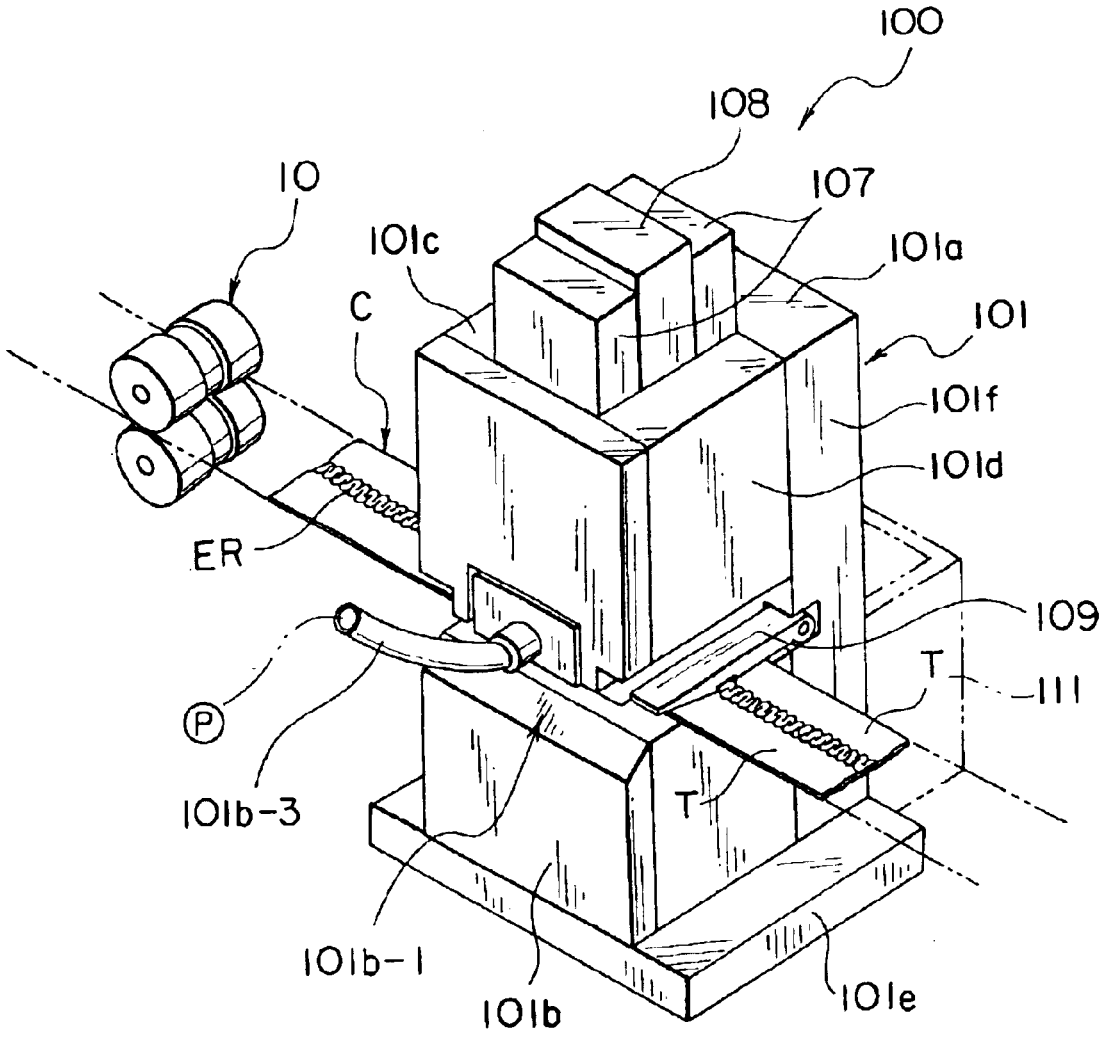
FIG. 1 is an appearance diagram schematically showing an entire composition example of a space forming apparatus for a slide fastener chain according to a typical embodiment of the present invention.

Most of the composition units and operating members of the aforementioned space forming apparatus 100 are accommodated in a single enclosed housing 101 which is assembled integrally in advance. This housing 101 is an entirely rectangular box, the inside of which is hollow, as schematically shown in FIG. 1. A center of a top wall portion 110*a* of the housing 101 is formed with an opening which is preliminarily set. An opening gap 101*b*-1 is formed across the entire width of the housing 1 at the center of a front side wall portion 101*b* thereof in the height direction thereof. Further, entire depth portions of right and left side wall portions 101*c*, 110*d* are cut out so as to communicate with the opening gap 101*b*-1, so that an insertion opening and part of a conveying path for the slide fastener chain C. A bottom wall portion 101*e* forms a base of the apparatus. The aforementioned opening gap 101*b*-1 is formed with a tapered face whose front side is expanded vertically so that the insertion of the slide fastener chain C can be facilitated.

Figure 2:
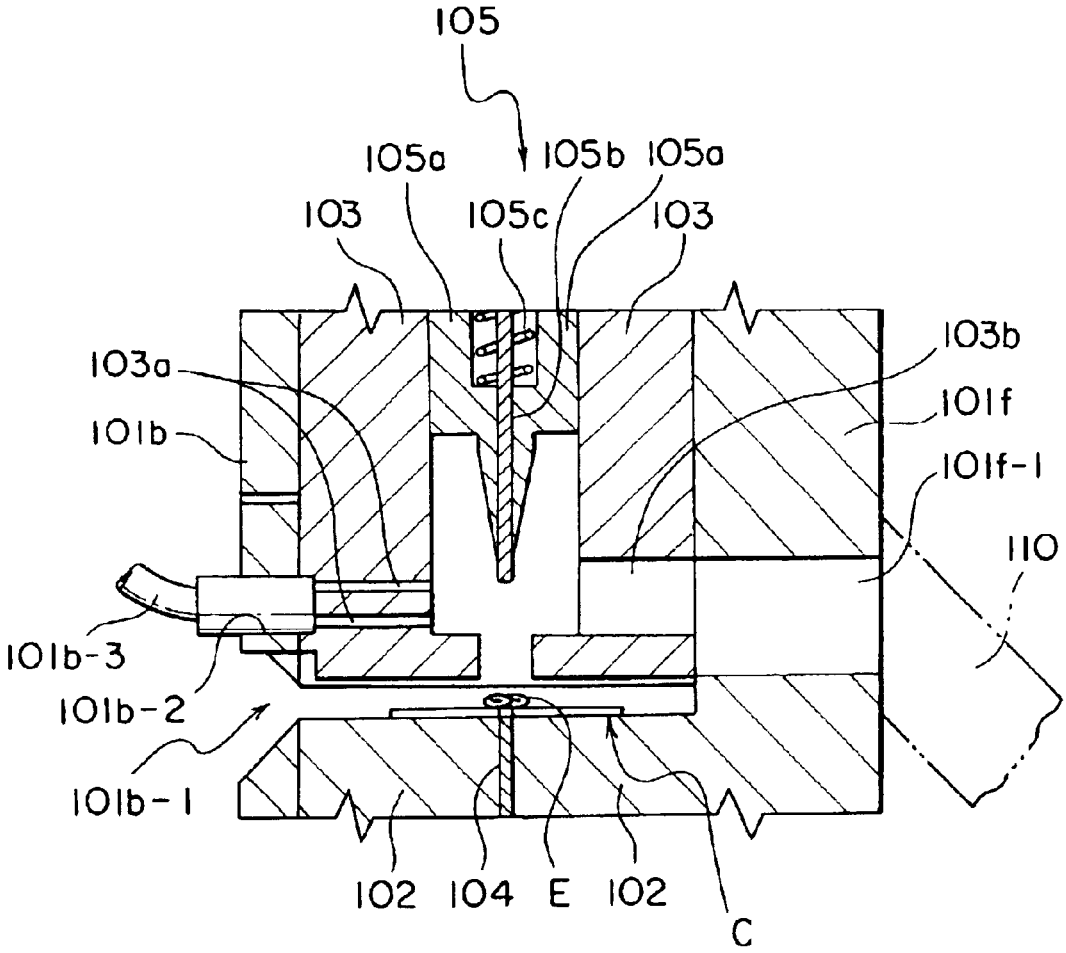
FIG. 2 is a sectional view of major components inside a housing of the same apparatus.

As shown in FIG. 2, through holes 101*b*-2 and 101*f*-1, which communicate with each other through an internal space, are formed in portions located above the insertion hole for the slide fastener chain C, of the front side wall portion 101*b* and rear sidewall portion 101*f*. Of these through holes 101*b*-2, 101*f*-1, the through hole 101*b*-2 formed in the front side wall portion 101*b* is formed in a wall portion separated from the front side wall portion 101*b* and fixed to a movable gripper 103, which will be described later, and connected to a pneumatic source P through a pipe 101*b*-3. The through hole 101*f*-1 formed in the rear side wall portion 101*f* is connected to a discharge shoot 110 extended outward from the rear side wall portion 101*f* as shown in FIG. 2. An accommodation case 111 for element cut wastes is disposed at the discharge end of the shoot 110.

Operating members 107, 108, which are operated while supporting the movable gripper 103 and a punch section 105, which will be described later, are provided in the opening formed in the center of the top wall portion 101*a* so as to be slidable in the vertical direction with respect to an inner face of the housing 101. The operating members 107, 108 are connected to a driving source such as an air cylinder (not shown), so as to move the movable gripper 103 and the punch section 105 vertically and synchronously at a predetermined timing.

A pair of right and left chain guide members 109, which are attached pivotally to the rear side wall portion 101*f*, are provided in a vertical gap in each of the right and left side wall portions 101*c*, 101*d* such that it traverses the conveying path of the slide fastener chain C so as to be swingable. This chain guide member 109 is provided at such a position that comes into a contact with each of the right and left end faces of the movable gripper 103. As for the operation, it swings vertically between a chain guide position and a release position by means of a spring (not shown).

Figure 3:
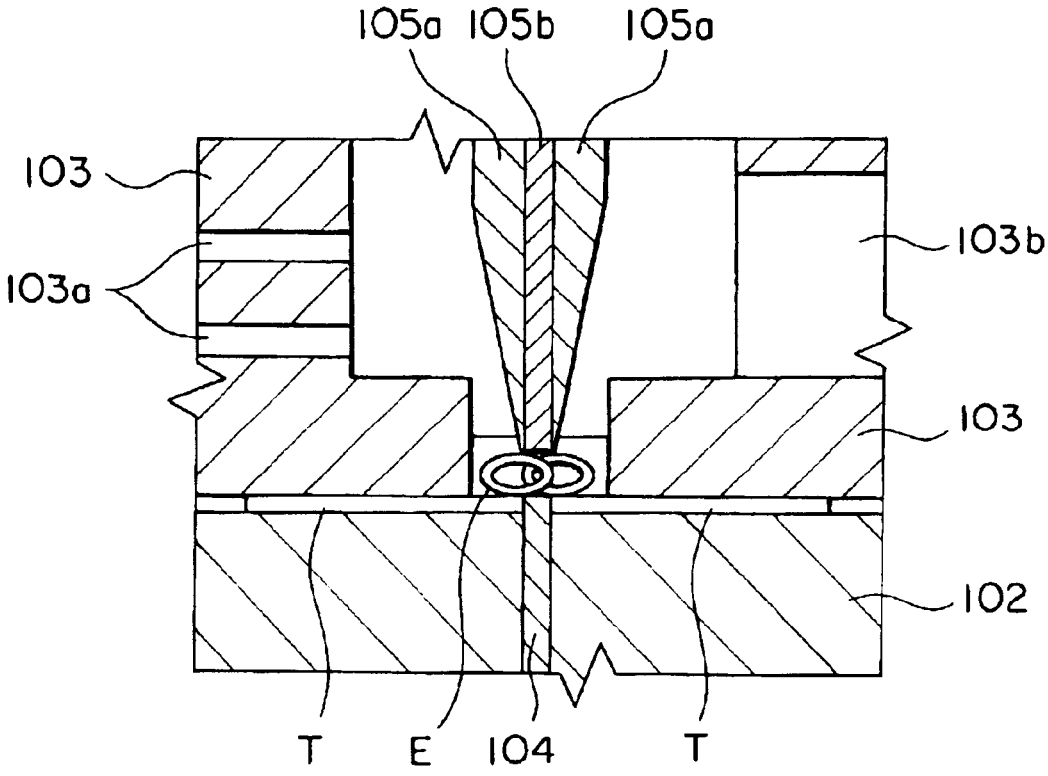
FIG. 3 is a sectional view of major components showing a state of an element being cut by means of a punch at the time of space formation.
Figure 4:
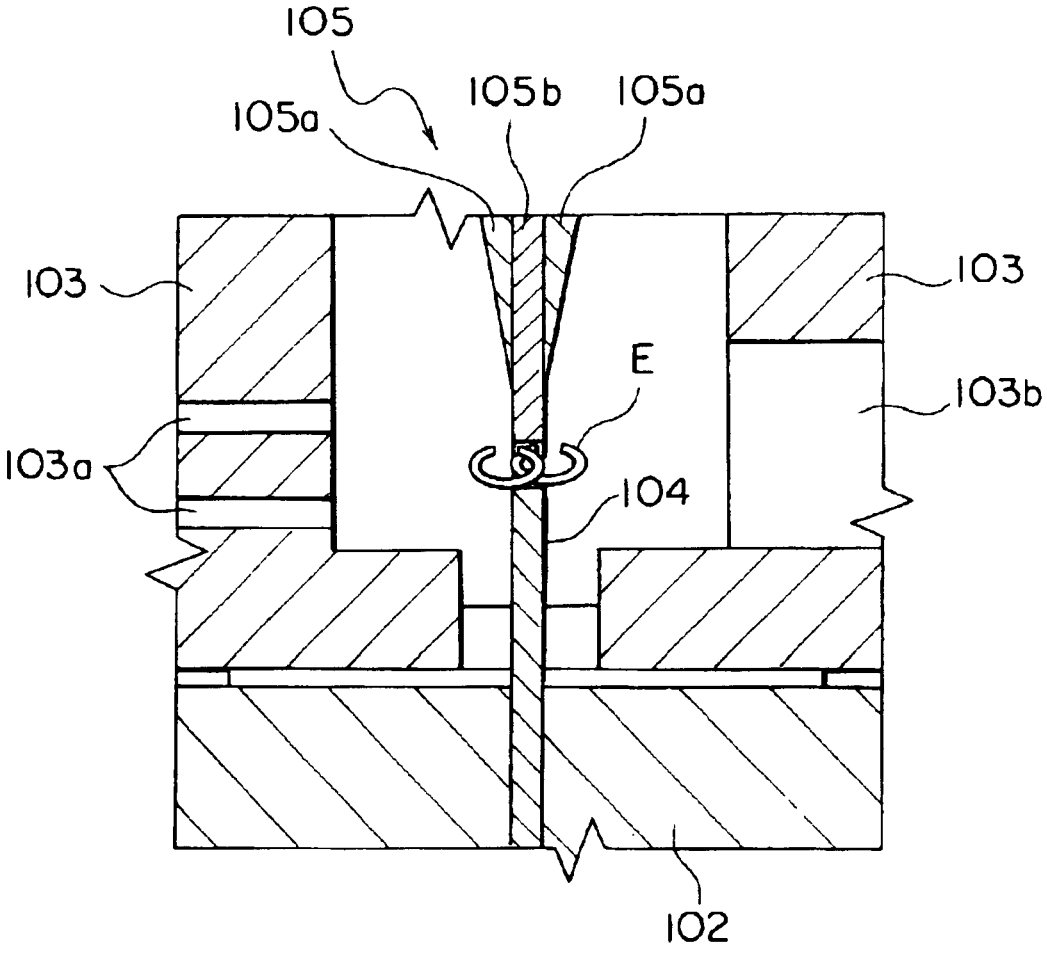
FIG. 4 is a sectional view of major components showing a state of cut wastes of elements being supported by means of the punch and a knock-out at the time of space formation.
Figure 5:
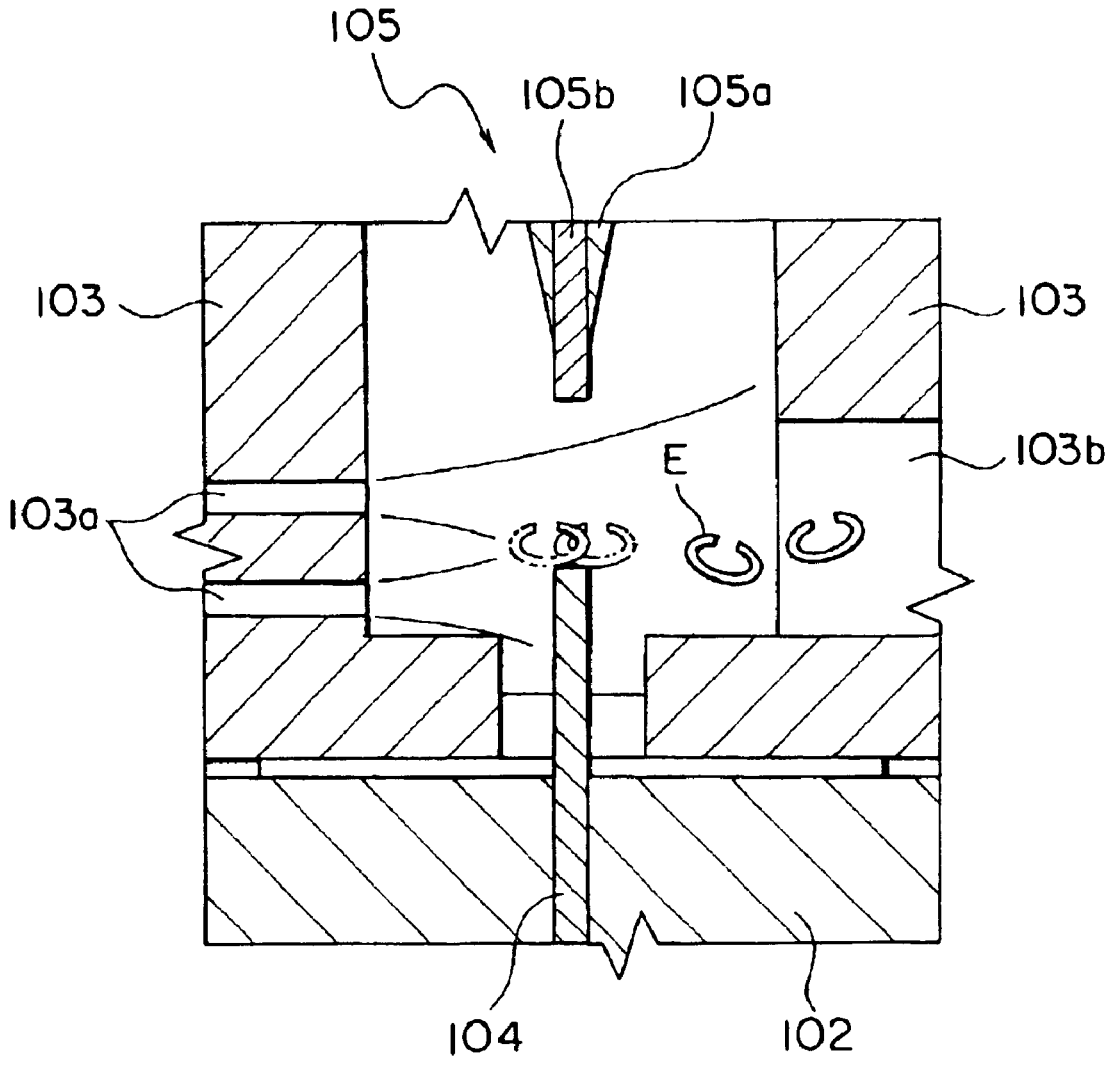
FIG. 5 is a sectional view of major components showing a state of the cut wastes of elements being discharged.

As shown in FIGS. 2 to 4, a pair of front and rear blocks, which form part of the conveying path for the slide fastener chain C, are fixed with a predetermined gap so as to sandwich a flat knock-out 104 therebetween, at the bottom portion inside the housing 101. Grip surfaces (not shown) are provided on top faces of the blocks. Thus a pair (front/rear) of fixing grippers 102 are composed. The aforementioned knock-out 104, which is driven vertically by such a driving source as a air cylinder (not shown), is interposed in the space formed between these fixing grippers 102. To cut out and remove the coupling element row in a space forming portion from below, a movable cutter, which moves vertically in accordance with the motion of the knock-out 104, may be provided between the front and rear fixing grippers 102, although it is not shown.

On the other hand, at least the aforementioned movable gripper 103, the punch section 105 and part of a well known operating mechanism (not shown) are accommodated inside the upper part of the housing 101 above the fastener insertion opening. The movable punch section 105 and the pair of front and rear movable grippers 103 move vertically between an upper waiting position and a lower grip position as being slidably guided by the front side wall portion 101*b*, the rear side wall portion 110*f* and the right and left side wall portions 101*c*, 110*d* of the housing 101, as shown in FIG. 2. The length of the movable grippers 103 and the punch section 105 in the slide-fastener-chain conveying direction is set to be substantially equal to the length of the fastener element space. However, the operating timings of the movable gripper 103 and the punch section 105 are differentiated as will be described later.

The punch section 105 comprises a pair of front and rear cutters 105*a* which move vertically, a punch 105*b* which moves vertically and independently between the same cutters 105*a* and a spring 105*c* for always urging the punch 105*b* upward. These components are moved at different strokes by the same driving source such as an air cylinder.

Through holes 103*a* and 103*b* are formed at corresponding portions of the pair of front and rear movable grippers 103, each opposing the through holes 101*b*-2, 101*f*-1 formed in the front side wall portion 101*b* and the rear side wall portion 101*f* of the housing 101 respectively. In the illustrated example, the through hole 103*a* formed in the front movable gripper 103 is comprised of two small holes disposed in parallel, while the through hole 103*b* on the rear side has a larger opening. This is because pneumatic pressure supplied from the pneumatic pressure source P is throttled into a high pressure, which is ejected into the housing 101, more specifically toward a cut-out element E.

Steps for forming a space in the slide fastener chain C with such a structure will be described in detail with reference to FIGS. 1 to 5.

Now, the slide fastener chain C is inserted into a slide-fastener-chain-insertion opening of the housing 101 through the opening gap 101*b*-1 as shown in FIG. 2. At this time, the chain guide member 109, which is disposed in each of the vertical gaps between the upper and lower parts of the right and left side wall portions 101*c* and 101*d* of the housing 1, is rotated upward while sagging a spring (not shown) as the slide fastener chain C is being inserted. When the insertion of the slide fastener chain C is completed, the chain guide members 109 are rotated downward to their respective guide positions by elastic restoration of the spring. Here, the chain supply unit 10 shown in FIG. 1 is driven so as to transfer the slide fastener chain C along the conveying path for the slide fastener chain C only by a length of a space to be formed. Then, the transference is stopped to execute positioning. The positioning of the slide fastener chain C at this time may adopt a conventionally well known positioning mechanism.

When the slide fastener chain C is stopped, first, the movable grippers 103 descend according to a normal method as shown in FIG. 3 so as to grip the coupling element rows ER of the slide fastener chain C with the pair of front and rear fixed grippers 102 in order to nip tape portions of the slide fastener chain under a pressure. Next, the punch section 105 descends, so that a punch 105*b* descends toward coupling heads of the coupling element rows ER supported by a top face of the knock-out 104 disposed between the front and rear fixed grippers 102. As a result, the coupling heads are pressed and positioned. Subsequently, leg portions of the coupling element rows ER are cut with a blade of the cutter 105*a*.

After this cutting is finished, as shown in FIG. 4, the punch section 105 ascends up to a predetermined position together with the knock-out 104 while nipping the cut coupling elements E. At this time, because the movable grippers 103 are left at the nipping position of the slide fastener chain C, the coupling elements nipped by the knock-out 104 and the punch 105*b* are removed from sewing threads of the slide fastener chain C and brought up to the predetermined position independently. The ascending positions of the knock-out 104 and the punch 105*b* are the positions opposing the through holes 103*a*, 103*b* formed in the pair of front and rear movable grippers 103, 103.

When the knock-out 104 and the punch 105*b* reach the aforementioned ascending positions, the outside pneumatic pressure source P is activated to eject compressed air from the through hole 101*b*-2 formed in the front side wall portion 101*b* of the housing 101. Because the punch 105*b* continues to ascend even after the knock-out 104 reaches the ascending position, the cut wastes of the coupling elements E indicated with phantom lines in FIG. 5, which are left on the top end of the knock-out 104, are discharged out through the through hole 101*f*-1 formed in the rear side wall portion 101*f* of the housing 101 by the aforementioned compressed air as indicated by solid lines. Therefore, because the cut wastes of the coupling elements E are discharged all together to the back side of the apparatus, no cut wastes are scattered around the apparatus by providing the rear side of the rear side wall portion 110*f* of the housing 101 with a discharge shoot 110 and a cut waste accommodation case 111.

When the cut wastes are removed from the top end of the knock-out 104, the knock-out 104 begins to descend and stops at a position where a top end thereof reaches the same level as a top face of the fixed grippers 102. Next, driving of the supply unit 10 for the slide fastener chain C is started, and after it is transferred by a length of a space to be formed, the slide fastener chain C is positioned and stopped. After that, the above-described operation is repeated so as to form spaces of a predetermined length successively in a long slide fastener chain at predetermined intervals.

When it is replaced with a new slide fastener chain C, the chain guide members 109 are rotated from a guide position to an upper release position. Then, the last slide fastener chain C is removed through the opening gap 101-*b* formed in the front side wall portion 101*b* of the housing 101 and a new slide fastener chain C is inserted. During this replacement of the slide fastener chain C, even if the movable grippers 103 and the punch section 105 should be actuated, the safety can be secured, because the opening gap 101*b*-1 is set to have a dimension not allowing the operator's finger to be inserted and the movable grippers 102 and the punch section 105 are located inside the housing 101 so as not to be exposed through the opening gap 101*b*-1.

As evident from the above description, in the space forming apparatus for the slide fastener chain C of the present invention, various kinds of the composition units and the operating members required for the space formation are accommodated in a single housing 101 which are formed integrally. Therefore, centering is facilitated at the time of assembly of the apparatus and guide supporting members for the composition units and the operating members are not required. As a result, the number of necessary components is reduced thereby achieving facilitation of the assembly work, reduction of price and compactness.

Further, because in the assembled apparatus, the interior of the housing 101 is substantially enclosed, the disposal of the cut wastes of the coupling elements E can be carried out effectively by using compressed air without damaging the surrounding environment.

Furthermore, Because various kinds of the composition units and operating members required for the space formation are accommodated within a single housing 101 formed integrally as described above, the design of the housing 101 can be discretionary to some extent, so that the insertion opening for the slide fastener chain C to be formed in the front side wall portion 101*b*-1 can be designed discretionally. Therefore, if the insertion opening for the slide fastener chain C is set to have a dimension that does not allow the operator's finger to be inserted therein, the safety can be secured against malfunction of the punch section and the like, without providing any special safety device.

[Description of Reference Numerals]

10: (Fastener) chain supply unit
100: Space forming apparatus
101: Housing
101a: Top wall portion
101b: Front side wall portion
101b-1: Opening gap
101b-2: Through hole
101b-3: Pipe
101c, 101d: Right and left side wall portions
101e: Bottom wall portion
101f: Rear side wall portion
101f-1: Through hole
102: Fixed gripper
103: Movable gripper
103a, 103b: Through hole
104: Knock-out
105: Punch section
105a: Cutter
105b: Punch
107: Operating member (movable gripper)
108: Operating member (punch section)
109: Chain guide member
110: Discharge shoot
111: Accommodating case
C: Slide fastener chain
T: Fastener tape
E: Coupling element
ER: Coupling element row

What is claimed:

1. A space forming apparatus comprising chain supplying means for intermittently supplying a long slide fastener chain, which is attached with right and left coupling elements continuously along opposing side edges of a pair of fastener tapes thereof, the space forming apparatus being disposed at a conveying path for said slide fastener chain to remove the coupling elements of a predetermined length successively from said slide fastener chain, wherein said space forming apparatus comprises:

a pair of fixed grippers forming at least part of the conveying path;

a pair of movable grippers which are cooperatively movable in a vertical direction toward and away from said slide-fastener-chain conveying path;

a knock-out, which is provided between said pair of fixed grippers and moves vertically between said fixed grippers and between said movable grippers;

and a punch section, which is disposed so as to oppose a top end of the knock-out and which moves vertically and independently between said pair of movable grippers and cuts coupling heads of the coupling elements while pressing the coupling heads at the time of being cut, and wherein said fixed grippers, said movable grippers, said knock-out and said punch section are accommodated integrally within a single housing having a conveying path for the slide fastener chain; and wherein the housing is a box, the inside of which is hollow;

wherein said fixed grippers and the knock-out are accommodated in a bottom portion inside the housing; and wherein said movable grippers and the punch section are accommodated in an upper portion inside the housing.

2. A space forming apparatus according to claim 1, wherein a chain insertion opening, which communicates with the conveying path for said slide fastener chain, is provided at a front of the housing.

3. A space forming apparatus according to claim 2, wherein an opening gap of the chain insertion opening and the conveying path for said slide fastener chain is set to be slightly larger than thickness of the slide fastener chain at a coupling element attaching portion thereof.

4. A space forming apparatus according to claim 1, wherein a top portion of said chain insertion opening of the housing, a rear side wall portion of the housing and said pair of movable grippers have through holes, which communicate with each other, the through hole formed at the top portion of said chain insertion opening of the housing being connected to an outside compressed air source via through a pipe.

5. A space forming apparatus according to claim 4, wherein the through holes of said pair of movable grippers are formed so as to communicate with at least said other through holes at a lower limit position of said movable grippers.

6. A space forming apparatus according to claim 1, wherein the housing further comprises:

a front side wall portion;

a rear side wall portion;

a right side wall portion; and a left side wall portion, wherein said movable grippers move vertically as being slidably guided by the front side wall portion, the rear side wall portion and the right and left side wall portions.

* * * * *